US012480252B2

(12) United States Patent
Sakagami et al.

(10) Patent No.: US 12,480,252 B2
(45) Date of Patent: Nov. 25, 2025

(54) ARTIFICIAL LEATHER

(71) Applicant: Toray Industries, Inc., Tokyo (JP)

(72) Inventors: Konomi Sakagami, Osaka (JP); Seiichiro Honda, Osaka (JP); Atsushi Shinozaki, Osaka (JP)

(73) Assignee: Toray Industries, Inc., Tokyo (JP)

( * ) Notice: Subject to any disclaimer, the term of this patent is extended or adjusted under 35 U.S.C. 154(b) by 255 days.

(21) Appl. No.: 18/036,006

(22) PCT Filed: Nov. 8, 2021

(86) PCT No.: PCT/JP2021/040912
§ 371 (c)(1),
(2) Date: May 9, 2023

(87) PCT Pub. No.: WO2022/113708
PCT Pub. Date: Jun. 2, 2022

(65) Prior Publication Data

US 2023/0416983 A1 Dec. 28, 2023

(30) Foreign Application Priority Data

Nov. 30, 2020 (JP) ..... 2020-197981

(51) Int. Cl.
*D06N 3/00* (2006.01)

(52) U.S. Cl.
CPC ..... *D06N 3/0065* (2013.01); *D06N 3/0004* (2013.01); *D06N 3/0011* (2013.01)

(58) Field of Classification Search
CPC . D06N 3/0004; D06N 2211/28; D06N 3/0011
See application file for complete search history.

(56) References Cited

U.S. PATENT DOCUMENTS

2004/0242100 A1* 12/2004 Nobuto ..... D04H 1/49
442/361
2013/0005848 A1* 1/2013 Koide ..... D06N 3/0004
521/170
2021/0070024 A1 3/2021 Kimura et al.

FOREIGN PATENT DOCUMENTS

CN 112538767 A 3/2021
JP 56112574 A 9/1981
(Continued)

OTHER PUBLICATIONS

International Search Report and Written Opinion for International Application No. PCT/JP2021/040912, dated Jan. 18, 2022, 6 pages.

*Primary Examiner* — Alicia J Weydemeyer
(74) *Attorney, Agent, or Firm* — Buchanan Ingersoll & Rooney PC

(57) ABSTRACT

A natural leather-like patterned artificial leather is provided which has a pattern with excellent wear resistance, while having an excellently delicate design, where the artificial leather is composed of: a fiber entangled body which comprises, as a constituent, a nonwoven fabric configured from ultrafine fibers that are formed from a thermoplastic resin, while having an average single fiber diameter of from 1 μm to 10 μm; and an elastomer. At least one surface of the artificial leather is a design surface having at least a piloerection part and a fused part, where the difference between the thickness of the piloerection part and the thickness of the fused part is from 0.05 mm to 0.20 mm; and the formulae (1) to (3) described below are satisfied.

$$\Delta E^*_{ab} \geq 5 \quad (1)$$

$$0 \leq \Delta H^*_{ab} \leq 1 \quad (2)$$

$$2D \leq \varphi \leq 150 \quad (3)$$

6 Claims, 2 Drawing Sheets

(56) References Cited

FOREIGN PATENT DOCUMENTS

| | | | | |
|---|---|---|---|---|
| JP | 5721573 | A | | 2/1982 |
| JP | 5865074 | A | | 4/1983 |
| JP | 07292579 | A | | 11/1995 |
| JP | 2002371478 | A | | 12/2002 |
| JP | 2017222961 | A | * | 12/2017 |
| JP | 2017222962 | A | | 12/2017 |
| WO | 2018211838 | A | | 11/2018 |

* cited by examiner

[Figure 1]
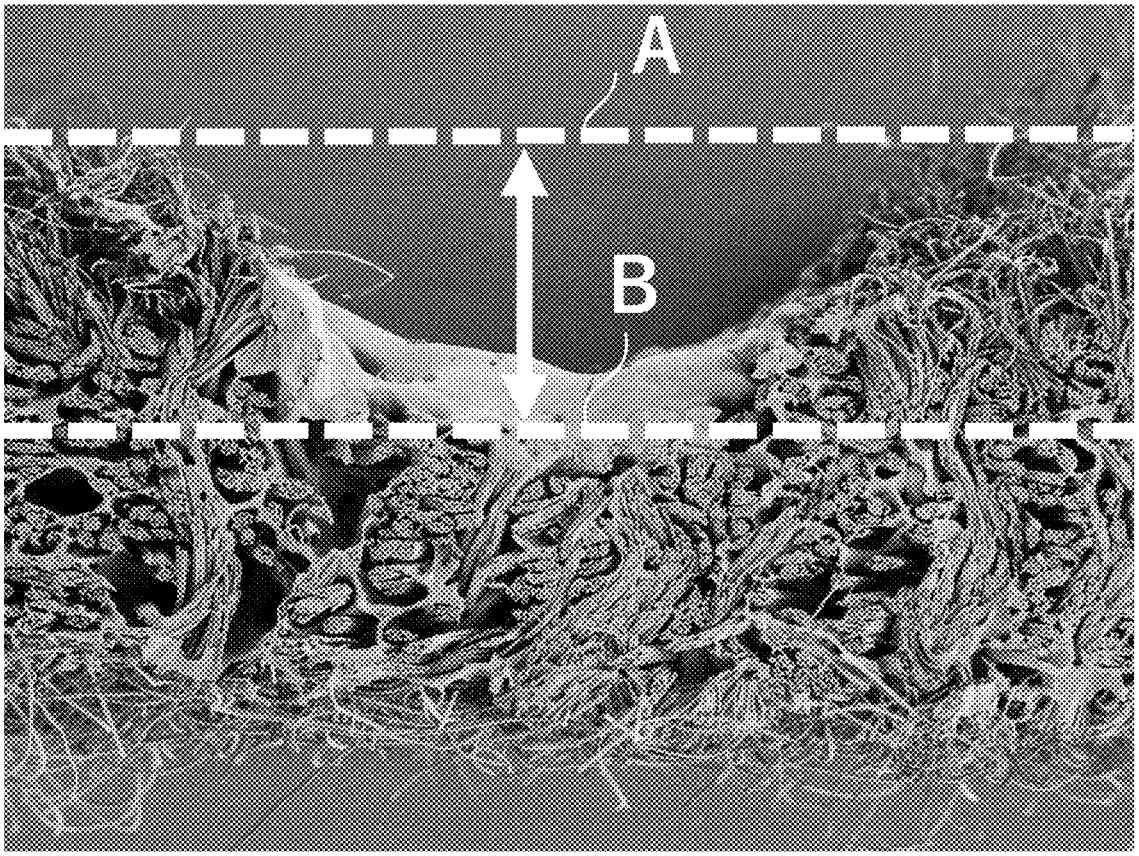

[Figure 2]
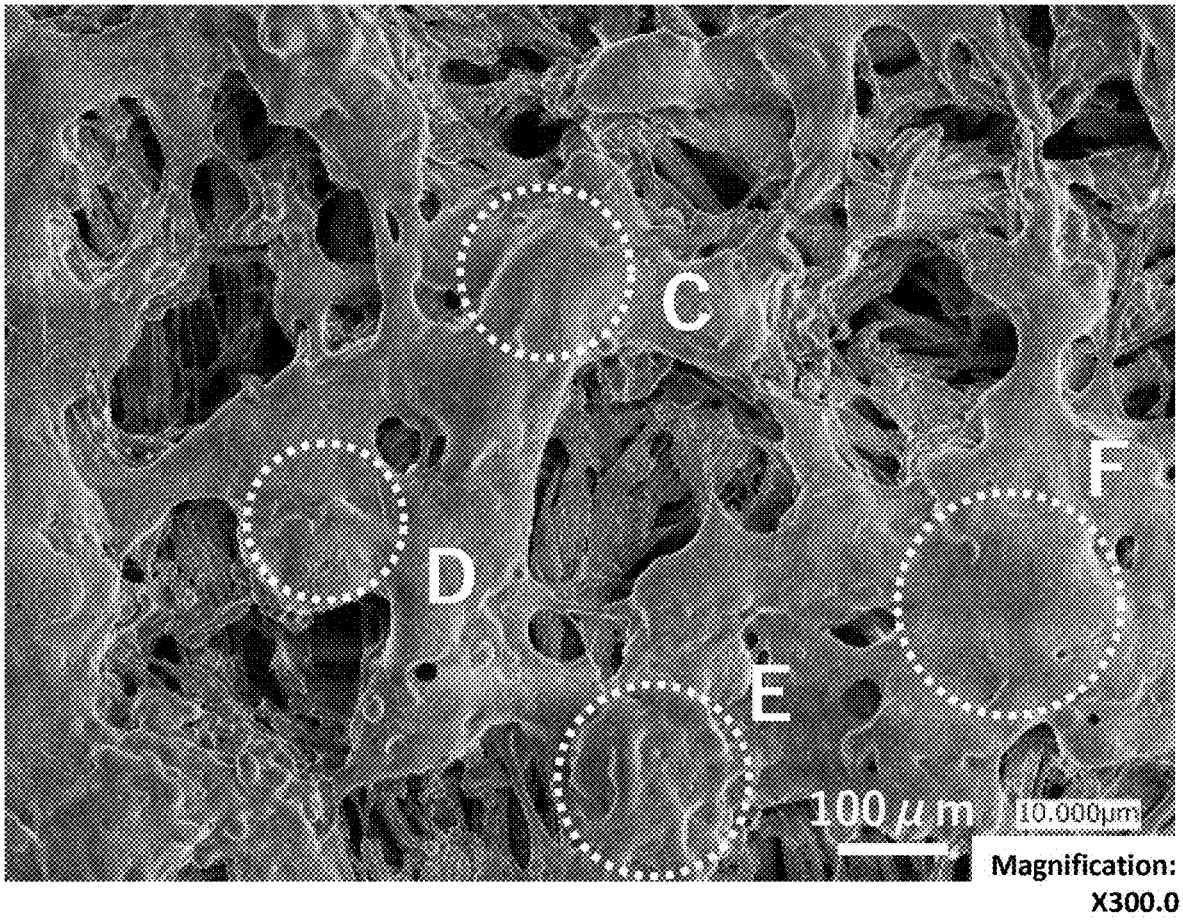

ARTIFICIAL LEATHER

CROSS REFERENCE TO RELATED APPLICATIONS

This application is the U.S. National Phase application of PCT/JP2021/040912, filed Nov. 8, 2021, which claims priority to Japanese Patent Application No. 2020-197981, filed Nov. 30, 2020, the disclosures of these applications being incorporated herein by reference in their entireties for all purposes.

FIELD OF THE INVENTION

The present invention relates to an artificial leather, and relates to an artificial leather excellent in wear resistance, while having a pattern with an excellently delicate designability.

BACKGROUND OF THE INVENTION

An artificial leather mainly including a fiber entangled body which contains, as a constituent, a nonwoven fabric that is configured from ultrafine fibers that are formed from a thermoplastic resin and an elastomer has excellent characteristics such as high durability and uniformity of quality in comparison with a natural leather and is used not only in clothing materials but also in various fields such as vehicle interior materials, interiors, shoes, and clothing. In particular, in recent years, due to diversification of consumer requirements, there is an increasing demand for artificial leather with a higher designability, in which a pattern is imparted to a surface, in any field.

In general, printing and embossing are known as a method for imparting a pattern to artificial leather. However, in the printing, while a free pattern can be imparted to artificial leather, improvement of wear resistance of a printed pattern is required for applications such as interior materials for vehicles, houses, and the like, which are easily abraded during use. On the other hand, the embossing has a problem that while an artificial leather having relatively excellent wear resistance is obtained, it is difficult to cope with a delicate pattern or to cope with production of various types, and the entire artificial leather is heated during embossing, so that the texture of the artificial leather is deteriorated.

Therefore, in order to improve the wear resistance of the pattern as described above or the deterioration in texture, a method has been proposed in which a black pigment such as graphite or carbon black is imprinted on a napped surface of artificial leather, and only fibers of a black pigment imprinting portion are heated and melted by infrared irradiation to fix the black pigment to the fibers to form a dark color concave portion (for example, refer to Patent Document 1).

PATENT DOCUMENTS

Patent Document 1: Japanese Patent Laid-open Publication No. 2002-371478

SUMMARY OF THE INVENTION

However, the technique disclosed in Patent Document 1 has problems that plate-making is required for each pattern, and it takes time to correct and change the pattern, and in addition, it is difficult to express a delicate pattern, and the technique cannot be applied to a black original fiber designed to contain a black pigment in the fiber itself for improving colorfastness to dyeing, and an artificial leather designed to contain a black pigment also in a elastomer for uniform color development.

Therefore, the present invention has been made in view of the above circumstances, and an object of the present invention is to provide a natural leather-like artificial leather with a pattern, which has a pattern excellent in wear resistance, is excellent in fine designability, and is also applicable to an artificial leather containing a black pigment in an ultrafine fiber or an elastomer, in an artificial leather including a fiber entangled body which contains, as a constituent, a nonwoven fabric that is configured from ultrafine fibers that are formed from a thermoplastic resin, and an elastomer.

As a result of repeated studies by the present inventors to achieve the above object, the present inventors have found that by setting at least one surface of artificial leather to a design surface having a piloerection part and a fused part, setting the thermoplastic resin in the fused material of the fused part to a specific content ratio, and setting the difference between the thickness of the piloerection part and the thickness of the fused part, a color difference $\Delta E^*_{ab}$ and a hue difference $\Delta H^*$ between the piloerection part and the fused part, and the size of the fused material of the fused part within specific ranges, and thereby an artificial leather excellent in wear resistance while exhibiting fine designability is obtained.

The present invention has been completed based on these findings. The present invention provides the following inventions.

That is, an artificial leather according to the present invention is composed of: a fiber entangled body which contains, as a constituent, a nonwoven fabric that is configured from ultrafine fibers that are formed from a thermoplastic resin, while having an average single fiber diameter of from 1 μm to 10 μm; and an elastomer. At least one surface of the artificial leather is a design surface that has at least a piloerection part and a fused part; if the content of the thermoplastic resin in the piloerection part is taken as 100 parts by mass, the content of the thermoplastic resin in a fused material in the fused part is from 99 parts by mass to 100 parts by mass; the difference between the thickness of the piloerection part and the thickness of the fused part is from 0.05 mm to 0.20 mm; and the formulae (1) to (3) described below are satisfied.

$$\Delta E^*_{ab} \geq 5 \quad (1)$$

$$0 \leq \Delta H^*_{ab} \leq 1 \quad (2)$$

$$2D \leq \varphi \leq 150 \quad (3)$$

Here, $\Delta E^*_{ab}$ is a CIELAB1976L*a*b* color difference between the piloerection part and the fused part, $\Delta H^*_{ab}$ is a CIELAB1976 hue difference between the piloerection part and the fused part, D is an average single fiber diameter (μm) of the ultrafine fibers, and φ is the size (μm) of the fused material.

According to a preferred aspect of the artificial leather of the present invention, the ultrafine fiber contains a black pigment in addition to the thermoplastic resin.

According to a preferred aspect of the artificial leather of the present invention, the elastomer contains a black pigment.

According to the present invention, an artificial leather excellent in wear resistance while exhibiting fine designability is obtained.

BRIEF DESCRIPTION OF THE DRAWINGS

FIG. 1 is a diagram exemplifying and describing a method for measuring a difference between a thickness of a piloerection part and a thickness of a fused part.

FIG. 2 is a diagram exemplifying and describing a method for measuring a size φ of a fused material.

DETAILED DESCRIPTION OF EMBODIMENTS OF THE INVENTION

An artificial leather according to the present invention is composed of: a fiber entangled body which contains, as a constituent, a nonwoven fabric that is configured from ultrafine fibers that are formed from a thermoplastic resin, while having an average single fiber diameter of from 1 μm to 10 μm; and an elastomer. At least one surface of the artificial leather is a design surface that has at least a piloerection part and a fused part; if the content of the thermoplastic resin in the piloerection part is taken as 100 parts by mass, the content of the thermoplastic resin in the fused part is from 99 parts by mass to 101 parts by mass; the difference between the thickness of the piloerection part and the thickness of the fused part is from 0.05 mm to 0.20 mm; and the formulae (1) to (3) described below are satisfied.

$$\Delta E^*_{ab} \geq 5 \quad (1)$$

$$0 \leq \Delta H^*_{ab} \leq 1 \quad (2)$$

$$2D \leq \varphi \leq 150 \quad (3)$$

Here, $\Delta E^*_{ab}$ is a CIELAB1976L*a*b* color difference between the piloerection part and the fused part, $\Delta H^*_{ab}$ is a CIELAB1976 hue difference between the piloerection part and the fused part, D is an average single fiber diameter (μm) of the ultrafine fibers, and φ is the size (μm) of the fused material. Hereinafter, the constituents will be described in detail, but the present invention is not limited to the scope described below at all as long as the gist thereof is not exceeded.

[Fiber Entangled Body]

As the thermoplastic resin to be used for the ultrafine fiber according to the present invention, any resin that can form a fiber form, such as a polyester-based resin of "polyethylene terephthalate, polybutylene terephthalate, polyester elastomer, and the like", a polyamide-based resin of "Polyamide 6, Polyamide 66, and polyamide elastomer", a polyurethane-based resin, a polyolefin-based resin, and an acrylonitrile-based resin, can be used, but a polyester-based resin is preferably used from the viewpoint of durability, particularly, mechanical strength, heat resistance, and the like.

Examples of the polyester-based resin include polyethylene terephthalate, polytrimethylene terephthalate, polytetramethylene terephthalate, polycyclohexylenedimethylene terephthalate, polyethylene-2,6-naphthalenedicarboxylate, and polyethylene-1,2-bis(2-chlorophenoxy)ethane-4,4'-dicarboxylate. Among them, polyethylene terephthalate, which is most commonly used, or a polyester copolymer mainly containing an ethylene terephthalate unit is preferably used.

As the polyester-based resin, a single polyester may be used or two or more different polyesters may be used, but when two or more different polyesters are used, from the viewpoint of compatibility of the two or more components, a difference in intrinsic viscosity (IV value) between the polyesters to be used is preferably 0.50 or less, and more preferably 0.30 or less.

In the present invention, the intrinsic viscosity is calculated by the following method.

(1) Dissolve 0.8 g of sample polymer in 10 mL of orthochlorophenol.

(2) Calculate the relative viscosity ηr by the following formula using an Ostwald viscometer at a temperature of 25° C. and rounded off to one decimal place.

$$\eta_r = \eta/\eta_0 = (t \times d)/(t_0 \times d_0)$$

Intrinsic viscosity (IV value)=$0.0242\eta_r$, +0.2634 (Here, η represents the viscosity of a polymer solution; $\eta_0$ represents the viscosity of orthochlorophenol; t represents the dropping time (seconds) of the solution; d represents the density of the solution (g/cm$^3$); $t_0$ represents the dropping time (seconds) of ortho-chlorophenol; and $d_0$ represents the density of ortho-chlorophenol (g/cm$^3$).)

In addition, the average single fiber diameter of the ultrafine fibers according to the present invention is 1 μm or more and 10 μm or less. When the average single fiber diameter of the ultrafine fiber is 1.0 μm or more, preferably 1.5 μm or more, an excellent effect of coloring property after dyeing, light resistance, fastness to rubbing, and stability during spinning is exhibited. On the other hand, when the average single fiber diameter is 10.0 μm or less, preferably 6.0 μm or less, more preferably 5.0 μm or less, it is possible to obtain an artificial leather that is dense and soft-to-the-touch surface quality.

In the present invention, the average single fiber diameter of ultrafine fibers is calculated by taking a scanning electron microscope (SEM, for example, "VHX-D500/D510" or "VE-7800", manufactured by Keyence Corp.) photograph of a cross-section of the artificial leather, randomly selecting 10 ultrafine fibers having a circular shape or an elliptical shape close to a circular shape, measuring the single fiber diameters, calculating the arithmetic average of the 10 fibers, and rounding the arithmetic average off to the first decimal place.

The cross-sectional shape of the ultrafine fiber according to the present invention is circular from the viewpoint of processing operability, and it is also possible to employ ultrafine fibers having a modified cross-sectional shape such as an ellipse, polygons such as a flattened polygon and a triangle, a fan shape, a cross shape, a hollow shape, a Y-shape, a T-shape, and a U-shape. In this case, the average single fiber diameter of the ultrafine fibers was determined by, first, measuring the cross-section area of each single fiber, and calculating the diameter when the cross-section was assumed to be circular.

In the present invention, in particular, when the artificial leather is caused to develop a dark color, and the like, it is preferable that the polyester-based resin constituting the ultrafine fiber contains a black pigment or a chromatic fine particle oxide pigment having an average particle diameter of 0.05 μm or more and 0.20 μm or less.

The particle diameter referred to herein is a particle diameter in a state in which the black pigment or the chromatic fine particle oxide pigment is present in the ultrafine fiber, and generally refers to a particle diameter referred to as a secondary particle diameter.

When the average particle diameter is preferably 0.05 μm or more, more preferably 0.07 μm or more, the black pigment or chromatic fine particle oxide pigment is gripped inside the ultrafine fiber, and therefore, falling off from the ultrafine fiber is suppressed. When the average particle diameter is preferably 0.20 μm or less, more preferably 0.18 μm or less, and still more preferably 0.16 μm or less, stability during spinning and yarn strength are excellent.

A content (A) of the black pigment or the chromatic fine particle oxide pigment contained in the polyester-based resin that forms the ultrafine fiber is preferably 0.5 mass % or more and 2.0 mass % or less with respect to the mass of the ultrafine fiber. When the proportion of the pigment is preferably 0.5% by mass or more, more preferably 0.7% by mass or more, and still more preferably 0.9% by mass or more, the deep color developability is excellent. When the proportion of the pigment is preferably 2.0% by mass or less, more preferably 1.8% by mass or less, and still more preferably 1.6% by mass or less, an artificial leather having high physical properties such as strength and elongation can be obtained.

As the black pigment in the present invention, carbon-based black pigments such as "carbon black and graphite", and oxide-based black pigments such as "triiron tetraoxide and composite oxides of copper and chromium" can be used. The black pigment is preferably carbon black from the viewpoint of easily obtaining a pigment having a small particle diameter and excellent dispersibility in a polymer.

The chromatic fine particle oxide pigment in the present invention refers to a chromatic color among the fine particle oxide pigments, and a white oxide pigment such as zinc oxide or titanium oxide is not contained in the chromatic fine particle oxide pigment.

As a chromatic fine particle oxide pigment, a known pigment close to the target color can be used, and examples thereof include iron oxyhydroxide (for example, "TM Yellow 8170" produced by Dainichiseika Color & Chemicals Mfg. Co., Ltd.), iron oxide (for example, "TM Red 8270" produced by Dainichiseika Color & Chemicals Mfg. Co., Ltd.), and cobalt aluminate (for example, "TM Blue 3490E" produced by Dainichiseika Color & Chemicals Mfg. Co., Ltd.).

In addition, inorganic particles such as titanium oxide particles, a lubricant, a thermal stabilizer, an ultraviolet absorber, a conductive agent, a heat storage agent, an antimicrobial agent and the like can be added to the thermoplastic resin forming the ultrafine fiber as necessary within a range not hindering the object of the present invention.

In the artificial leather of the present invention, a fiber entangled body which contains, as a constituent, a nonwoven fabric that is configured from ultrafine fibers that are formed from a thermoplastic resin is one of the constituents.

In the present invention, "fiber entangled body which contains, as a constituent, a nonwoven fabric" refers to an aspect in which the fiber-entangled body is a nonwoven fabric, an aspect in which the fiber-entangled body is formed by integrating by entanglement and integrating a nonwoven fabric and a woven fabric as described later, and an aspect in which the fiber-entangled body is formed by integrating by entanglement of a nonwoven fabric and a substrate other than a woven fabric, and the like.

With the fiber entangled body which contains, as a constituent, a nonwoven fabric, it is possible to provide an appearance and a touch that are uniform and elegant when the surface of the nonwoven fabric is napped.

Examples of the form of the nonwoven fabric include a long fiber nonwoven fabric mainly composed of filaments and a short fiber nonwoven fabric mainly composed of fibers of 100 mm or less. When the long fiber nonwoven fabric is used as a form of nonwoven fabric, an artificial leather having excellent strength can be obtained, which is preferable. On the other hand, in the case of the short fiber nonwoven fabric, the number of fibers oriented in the thickness direction of the artificial leather can be increased as compared with the case of the long fiber nonwoven fabric, and the surface of the artificial leather when napped can have a high dense feeling.

The fiber length of the ultrafine fibers in the case where a short fiber nonwoven fabric is used is preferably 25 mm or more and 90 mm or less. When the fiber length is preferably 90 mm or less, more preferably 80 mm or less, and still more preferably 70 mm or less, good quality and texture are obtained. On the other hand, when the fiber length is preferably 25 mm or more, more preferably 35 mm or more, and still more preferably 40 mm or more, an artificial leather with excellent wear resistance can be obtained.

The basis weight of the nonwoven fabric that constitutes the artificial leather according to the present invention is measured according to "6.2 Mass per Unit Area (ISO method)" in "Test methods for nonwovens" of JIS L 1913: 2010, and is preferably in a range of 50 g/m 2 or more and 400 g/m 2 or less. When the basis weight of the nonwoven fabric is preferably 50 g/m 2 or more, more preferably 80 g/m 2 or more, an artificial leather having a sense of fulfillment and an excellent texture can be obtained. On the other hand, when the basis weight is preferably 400 g/m 2 or less, more preferably 300 g/m 2 or less, a soft artificial leather having excellent moldability can be obtained.

In the artificial leather of the present invention, for the purpose of improving the strength and form stability of the artificial leather, it is preferable to stack and integrate by entanglement of a woven fabric inside or on one side of the nonwoven fabric.

As the type of fiber constituting the woven fabric used when the woven fabric is integrated by entanglement, it is preferable to use a filament yarn, a spun yarn, a mixed composite yarn of the filament yarn and the spun yarn, or the like, and it is more preferable to use a multifilament made of a polyester-based resin or a polyamide-based resin from the viewpoint of durability, particularly mechanical strength, or the like.

From the viewpoint of the mechanical strength and the like, the fiber constituting the woven fabric preferably does not contain a black pigment or a chromatic fine particle oxide pigment.

When the average single fiber diameter of the fibers that constitute the woven fabric is preferably 50 μm or less, more preferably 15 μm or less, and still more preferably 13 μm or less, not only an artificial leather excellent in flexibility is obtained, but also even when the fibers of the woven fabric are exposed on the surface of the artificial leather, a hue difference from the ultrafine fiber containing the pigment after dyeing is reduced, so that uniformity of a hue of the surface is not impaired. On the other hand, when the average single fiber diameter is preferably 1 μm or more, more preferably 8 μm or more, and still more preferably 9 μm or more, shape stability of a product as an artificial leather is improved.

In the present invention, the average single fiber diameter of fibers constituting the woven fabric is calculated by taking a scanning electron microscope (SEM, for example, "VHX-D500/D510", "VE-7800", or the like, manufactured by Keyence Corp.) photograph of a cross-section of the artificial leather, randomly selecting 10 ultrafine fibers constituting the woven fabric, measuring the single fiber diameters of the fibers, calculating the arithmetic average of the 10 fibers, and rounding the arithmetic average off to the first decimal place.

When the fibers that constitute the woven fabric are multifilaments, a total fineness of the multifilaments is measured according to "8.3.1 Fineness based on corrected mass b) Method B (simple method)" in "8.3 Fineness" in JIS L 1013: 2010 "Chemical fiber filament yarn test method", and is preferably 30 dtex or more and 170 dtex or less.

When the total fineness of the yarns that constitute the woven fabric is preferably 170 dtex or less, an artificial leather excellent in flexibility is obtained. On the other hand, when the total fineness is preferably 30 dtex or more, not only the shape stability of a product as the artificial leather is improved, but also the fibers that constitute the woven fabric are less likely to be exposed on the surface of the artificial leather when the nonwoven fabric and the woven fabric are integrated by entanglement by needle punching or the like, which is preferable. At this time, the multifilaments of the warp and the weft preferably have the same total fineness.

In addition, the yarns constituting the woven fabric preferably have a twist count of 1000 T/m or more and 4000 T/m or less. When the twist count is preferably 4,000 T/m or less, more preferably 3,500 T/m or less, and still more preferably 3,000 T/m or less, an artificial leather excellent in flexibility is obtained. When the twist count is preferably 1,000 T/m or more, more preferably 1,500 T/m or more, and still more preferably 2,000 T/m or more, in a case where a nonwoven fabric and a woven fabric are integrated by entanglement by needle punching or the like, damage to fibers constituting the woven fabric can be prevented, and the mechanical strength of the artificial leather is excellent, which is preferable.

[Elastomer]

The elastomers used in the artificial leather of the present invention include polyurethane, polyurea, polyurethane/polyurea elastomers, polyacrylic acid, acrylonitrile/butadiene elastomers, and styrene/butadiene elastomers, of which polyurethane is preferable from the viewpoint of flexibility and cushioning properties.

Furthermore, the elastomers may contain elastomer resins such as a polyester-based resin, a polyamide-based resin, or a polyolefin-based resin, an acrylic resin, or an ethylene-vinyl acetate resin. The elastomer may be either dissolved in an organic solvent or dispersed in water.

As the polyurethane used in the present invention, either organic solvent-based polyurethane used in the state of being dissolved in an organic solvent or water-dispersible polyurethane used in the state of being dispersed in water can be used. Polyurethane obtained by reaction of a polymer diol, an organic diisocyanate, and a chain extender is preferably used as polyurethane to be used for the present invention.

For example, a polycarbonate-based diol, polyester-based diol, polyether-based diol, silicone-based diol, or fluorine-based diol can be used as the aforementioned polymer diol, and a copolymer of a combination of these diols can also be used. Among them, it is a preferred aspect to use a polycarbonate-based diol from the viewpoint of hydrolysis resistance and wear resistance.

A polycarbonate-based diol as described above can be produced, for example, through ester exchange reaction between alkylene glycol and ester carbonate or through reaction of phosgene or a chloroformate with alkylene glycol.

Examples of the alkylene glycol include linear alkylene glycols such as "ethylene glycol, propylene glycol, 1,4-butanediol, 1,5-pentanediol, 1,6-hexanediol, 1,9-nonanediol, and 1,10-decanediol", branched alkylene glycols such as "neopentyl glycol, 3-methyl-1,5-pentanediol, 2,4-diethyl-1,5-pentanediol, and 2-methyl-1,8-octanediol", alicyclic diols such as 1,4-cyclohexanediol, aromatic diols such as bisphenol A, and glycerin, trimethylolpropane, and pentaerythritol. In the present invention, either a polycarbonate-based diol obtained from a single alkylene glycol or a copolymerized polycarbonate-based diol obtained from two or more alkylene glycols can be adopted.

Examples of the polyester-based diols include polyester diols produced by condensing one of various low molecular weight polyols and a polybasic acid.

For example, one or a plurality selected from the following can be used as the low molecular weight polyol described above: ethylene glycol, 1,2-propylene glycol, 1,3-propylene glycol, 1,3-butane diol, 1,4-butane diol, 2,2-dimethyl-1,3-propane diol, 1,6-hexane diol, 3-methyl-1,5-pentane diol, 1,8-octane diol, diethylene glycol, triethylene glycol, dipropylene glycol, tripropylene glycol, cyclohexane-1,4-diol, and cyclohexane-1,4-dimethanol.

Adducts prepared by adding various alkylene oxides to bisphenol A are also usable.

Furthermore, for example, one or a plurality selected from the following can be used as the polybasic acid: succinic acid, maleic acid, adipic acid, glutaric acid, pimelic acid, suberic acid, azelaic acid, sebacic acid, dodecane dicarboxylic acid, phthalic acid, isophthalic acid, terephthalic acid, and hexahydroisophthalic acid.

Examples of the polyether-based diols used in the present invention include polyethylene glycol, polypropylene glycol, polytetramethylene glycol, and copolymerized diols which are formed by combining these substances.

The number average molecular weight of the polymer diol is preferably in a range of 500 or more and 4000 or less when the molecular weight of a polyurethane-based elastomer is constant. When the number average molecular weight is preferably 500 or more, more preferably 1,500 or more, it is possible to prevent the artificial leather from becoming hard. Furthermore, a number average molecular weight of preferably 4,000 or less, more preferably to 3,000 or less, allows the polyurethane to maintain a required inherent strength.

Examples of the organic diisocyanate used in the present invention include aliphatic diisocyanates such as "hexamethylene diisocyanate, dicyclohexylmethane diisocyanate, isophorone diisocyanate, and xylylene diisocyanate", and aromatic diisocyanates such as "diphenylmethane diisocyanate and tolylene diisocyanate". These compounds can also be used in combination.

As the chain extender, amine chain extenders such as ethylenediamine and methylenebisaniline, or diol chain extenders such as ethylene glycol can be preferably used. Furthermore, a polyamine which is obtained by reacting polyisocyanate and water can also be used as chain extending agent.

The polyurethane used in the present invention may be used in combination with a crosslinker with the aim of improving waterproofness, wear resistance, hydrolysis resistance, and the like. The crosslinking agent may be an external crosslinking agent that is added as a third component to the polyurethane, or an internal crosslinking agent that introduces reaction points to form a crosslinked structure in advance into the polyurethane molecular structure. It is preferable to use an internal crosslinker from the viewpoint that crosslinking points can be formed more uniformly in the polyurethane molecular structure and that the decrease in flexibility can be mitigated.

The crosslinking agent used may be a compound having an isocyanate group, an oxazoline group, a carbodiimide group, an epoxy group, a melamine resin, a silanol group and the like.

The elastomer may contain carbon black, other pigments, a dye antioxidant, an antioxidant, a light resisting agent, an antistatic agent, a dispersing agent, a softening agent, a solidification adjustor, a flame retardant, an antibacterial agent, a deodorant, and the like as required. In particular, an aspect in which the elastomer according to the present invention contains a black pigment is more preferable.

Generally, the content of the elastomer in the artificial leather can be appropriately adjusted in consideration of the kind of the elastomer used, the method for manufacturing the elastomer, and the texture and physical properties. However, in the present invention, the content of the elastomer is preferably 10 mass % or more and 60 mass % or less with respect to the mass of the fiber entangled body. When the content of the elastomer is preferably 10% by mass or more, more preferably 15% by mass or more, still more preferably 20% by mass or more, the bonding between the fibers by the elastomer can be enhanced, and the wear resistance of the artificial leather can be improved. On the other hand, when the content of the elastomer is preferably 60% by mass or less, more preferably 45% by mass or less, still more preferably 40% by mass or less, the flexibility of the artificial leather can be further increased.

[Artificial Leather]

The artificial leather of the present invention contains the fiber entangled body and the elastomer as constituents. At least one surface of the artificial leather is a design surface having at least a piloerection part and a fused part. The design surface referred to herein is a surface that comes to the outermost side when it becomes a product. In addition, the piloerection part is a portion having a piloerection made of ultrafine fibers on the surface, and the fused part is a portion where the thermoplastic resin mainly constituting the ultrafine fibers is fused in a lump, that is, a portion where a fused material exists.

In this piloerection part, the piloerection preferably has a length and direction flexibility to such an extent that traces remain when the skin sheet is stroked with a finger, that is, a so-called finger mark remain due to the change of direction of the piloerection from the viewpoint of design effects.

More specifically, the piloerection length in the piloerection part on the surface is preferably 200 μm or more and 500 μm or less, and more preferably 250 μm or more and 450 μm or less. When the piloerection length is preferably 200 μm or more, the piloerection covers the elastomer, and the exposure of the elastomer on the surface of the artificial leather is suppressed, so that an artificial leather having uniform coloring can be obtained. When the fiber entangled body constituting the artificial leather is formed by integrating by entanglement of a nonwoven fabric and a woven fabric, setting the piloerection length of the piloerection part on the surface within the above range is preferable because fibers of the woven fabric in the vicinity of the surface of the artificial leather can be sufficiently covered. On the other hand, when the piloerection length is preferably 500 μm or less, an artificial leather excellent in design effect and wear resistance can be obtained.

In the present invention, the piloerection length of the piloerection part on the surface of the artificial leather is calculated by the following method.

(1) A thin slice with a thickness of 1 mm in the cross-sectional direction of a plane perpendicular to the longitudinal direction of the artificial leather is prepared in the state where the piloerection of the piloerection part on the surface of the artificial leather is ruffled by using a lint brush, or the like.

(2) A cross-section of the piloerection part on the surface of the artificial leather is observed with a scanning electron microscope (SEM, for example, "VHX-D500/D510", "VE-7800", or the like, manufactured by Keyence Corp.) at 90 times.

(3) In an SEM image photographed, the height of a layer including only ultrafine fibers is measured at 10 points at intervals of 200 μm in the width direction of the cross-section of the piloerection part on the surface of the artificial leather.

(4) With respect to the measured height of the layer including only ultrafine fibers at 10 points, the average value (arithmetic average value) is calculated.

In the artificial leather of the present invention, when the content of the thermoplastic resin in the piloerection part is 100 parts by mass, the content of the thermoplastic resin in the fused part is 99 parts by mass or more and 101 parts by mass or less. In this way, by not providing a difference in content between the piloerection part and the fused part, the mechanical properties of the artificial leather are improved.

In the present invention, the ratio of the content of the thermoplastic resin in the fused part to the content of the thermoplastic resin in the piloerection part of the artificial leather is calculated by the following method.

(1) For the piloerection part, $^{1}$H-NMR is measured using a nuclear magnetic resonance apparatus (NMR), and the content ratio of the thermoplastic resin as the main component is calculated from the obtained peak area.

(2) Also for the fused part, the content ratio of the same thermoplastic resin as the thermoplastic resin of the main component of the piloerection part is calculated in the same manner as in (1).

(3) When the content ratio of the thermoplastic resin in the piloerection part is 100 parts by mass, the content ratio of the thermoplastic resin in the fused part is calculated.

Furthermore, in the artificial leather of the present invention, a difference between the thickness of the piloerection part and the thickness of the fused part is 0.05 mm or more and 0.20 mm or less. By setting the difference between the thickness of the piloerection part and the thickness of the fused part to 0.05 mm or more, preferably 0.07 mm or more, and more preferably 0.10 mm or more, it is possible to provide an artificial leather having sufficient visibility of a pattern and excellent designability. By setting the difference between the thickness of the piloerection part and the thickness of the fused part to 0.20 mm or less, preferably 0.19 mm or less, and more preferably 0.18 mm or less, deterioration of flexibility due to excessive fusion of the ultrafine fibers and thermal deterioration of the elastomer is prevented, and the texture is excellent.

The difference between the thickness of the piloerection part and the thickness of the fused part refers to a value obtained by observing a cross-section perpendicular to the thickness direction of the artificial leather at a magnification of 200 times with a scanning electron microscope (SEM, for example, "VHX-D500/D510", "VE-7800", or the like, manufactured by Keyence Corp.), measuring an observed height difference between the piloerection part and the fused part as a distance A-B between the uppermost point A and the lowermost point B exemplified in FIG. 1, and rounding off an average value of 20 randomly extracted convex portions. Here, for the lowermost point B, the lower one of the positions where the inclination of both ends disappears (0°) is selected in the convex portion.

The artificial leather of the present invention preferably has a piloerection part thickness of 0.2 mm or more and 2.8 mm or less as measured according to "6.1.1 A method" in "6.1 Thickness (ISO method)" in "Test methods for nonwovens" of JIS L 1913: 2010 When the thickness of the artificial leather is 0.2 mm or more, more preferably 0.3 mm or more, and still more preferably 0.4 mm or more, not only excellent processability at the time of production is obtained, but also a sense of fulfillment and excellent texture are obtained. On the other hand, when the thickness is 2.8 mm or less, more preferably 2.7 mm or less, and still more preferably 2.6 mm or less, a soft artificial leather having excellent moldability can be obtained.

In the artificial leather of the present invention, it is important that the color difference $\Delta E^*_{ab}$ and the hue difference $\Delta H^*$between the piloerection part and the fused part satisfy the following formulas (1) and (2), respectively.

$$\Delta E^*_{ab} \geq 5 \quad (1)$$

$$0 \leq \Delta H^* \leq 1.0 \quad (2)$$

By setting $\Delta E^*_{ab}$ to 5 or more, preferably 5.5 or more, and more preferably 6 or more, a pattern having sufficient visibility is obtained. In addition, by setting $\Delta H^*$to 0 or more and 1.0 or less, preferably 0 or more and 0.9 or less, and more preferably 0.8 or less, it is possible to impart an elegant designability in which the pattern fits without standing out and is not noticeable while securing sufficient visibility.

The color difference $\Delta E^*_{ab}$ and the hue difference $\Delta H^*$ between the piloerection part and the fused part are measured as follows.

(1) Using a spectrophotometer (for example, "CM-2600d", or the like, manufactured by Konica Minolta, Inc.), measurements are randomly made at five points on the piloerection part on the surface, and the average values are defined as the average brightness L*, and the average hues a* and b* of the piloerection part.

(2) The fused part on the surface is also measured at five points in the same manner, and the average values thereof are defined as the average brightness L*, and the average hue a* and the average hue b* of the fused parts.

(3) The color difference $\Delta E^*_{ab}$ and the hue difference $\Delta H^*$ between the piloerection part and the fused part are calculated from the obtained average brightness L*, and average hues a* and b* by the following formula.

$$\Delta L^* = (\text{average brightness } L^* \text{ of piloerection part}) - (\text{average brightness } L^* \text{ of fused part})$$

$$\Delta a^* = (\text{average brightness } a^* \text{ of piloerection part}) - (\text{average brightness } a^* \text{ of fused part})$$

$$\Delta b^* = (\text{average brightness } b^* \text{ of piloerection part}) - (\text{average brightness } b^* \text{ of fused part})$$

$$\Delta E^*_{ab} = \{(\Delta L^*)^2 + (\Delta a^*)^2 + (\Delta b^*)^2\}^{1/2}$$

$$\Delta C^* = \{(\Delta a^*)^2 + (\Delta b^*)^2\}^{1/2}$$

$$\Delta H^* = \{(\Delta a^*)^2 + (\Delta b^*)^2 - (\Delta c^*)^2\}^{1/2}$$

Here, in a case where the size of the fused part is less than 3 mm in diameter, it is possible to perform measurement by the same method as described above by cutting off a plurality of fused parts and arranging them without a gap.

It is also important that the artificial leather of the present invention satisfies the following Formula (3).

$$2D \leq \varphi \leq 150 \quad (3)$$

Here, D is the average single fiber diameter (μm) of the ultrafine fibers, and φ is the size (μm) of the fused material. By setting the size φ (μm) of the fused material to 2D or more (2D φ, and the same applies hereinafter.), preferably 2.5 D or more (2.5 D≤φ), and more preferably 3D or more (3D≤φ), it is possible to obtain an artificial leather in which visibility of a pattern is sufficient. On the other hand, when the size of the fused material is 150 μm or less (φ≤150, and the same applies hereinafter.), preferably 140 μm or less (φ≤140), and more preferably 130 μm or less (φ≤130), a boundary portion of a clear pattern and a fine pattern can be expressed, and the designability is excellent.

In the present invention, the fused material of the fused part of the artificial leather is calculated by the following method.

(1) A fused part on the surface of the artificial leather is observed with a scanning electron microscope (SEM, for example, "VHX-D500/D510", "VE-7800", or the like, manufactured by Keyence Corp.) at 300 times.

(2) As exemplified in FIG. 2, the maximum diameter (5 μm increments) of a circle that can be included in the fused material is measured. In FIG. 2, a circle having a diameter of 150 μm at the point C, a circle having a diameter of 140 μm at the point D, a circle having a diameter of 170 μm at the point E, and a circle having a diameter of 200 μm at the point F can be included.

(3) For randomly selected 10 fused parts, the maximum diameter of a circle that can be included in a fused material is measured, and the maximum value is defined as the size of the fused material.

In the artificial leather of the present invention, the rubbing fastness of the piloerection part measured by a "9.1 friction tester type I (clock meter) method" according to JIS L 0849: 2013 "Test methods for color fastness to rubbing" and light fastness measured by a "7.2 Exposure method a) First exposure method" according to JIS L 0843: 2006 "Test method for color fastness to light of xenon arc lamp" are each preferably grade 4 or higher. When the rubbing fastness and the light fastness are grade 4 or higher, it is possible to prevent color loss and contamination of clothes and the like during actual use.

In addition, in the artificial leather of the present invention, the mass loss of the artificial leather after 20,000 times of abrasion under a pressing load of 12.0 kPa in an abrasion test measured in accordance with "8.19.5 Method E (Martindale method)" of "8.19 Abrasion strength and color change by rubbing" of JIS L 1096: 2010 "Cloth experiment method of woven fabric and knitted fabric" is preferably 10 mg or less, more preferably 8 mg or less, still more preferably 6 mg or less. When the mass loss is 10 mg or less, contamination due to fluff dropping during actual usage can be prevented.

In addition, the artificial leather of the present invention, the tensile strength as measured in accordance with "6.3.1 Tensile strength and percentage elongation (ISO method)" in "Test methods for nonwovens" of JIS L 1913: 2010 is preferably from 20 N/cm or more and 200 N/cm or less in optional measurement direction.

When the tensile strength is preferably 20 N/cm or more, more preferably 30 N/cm or more, and still more preferably 40 N/cm or more, the artificial leather can be excellent in shape stability and durability. When the tensile strength is preferably 200 N/cm or less, more preferably 180 N/cm or less, and still more preferably 150 N/cm or less, an artificial leather more excellent in moldability is obtained.

[Production Method for Artificial Leather]

The artificial leather of the present invention is preferably produced by including the following steps (1) to (5).

Step (1): Step of forming an island portion formed of a thermoplastic resin to be an ultrafine fiber, and producing an ultrafine fiber-generating fiber having an islands-in-the-sea fiber structure in which an easily soluble polymer forms a sea portion.

Step (2): Step of producing a fibrous substrate containing an ultrafine fiber-generating fiber as a main component.

Step (3): Step of developing an ultrafine fiber having an average single fiber diameter of 1 μm or more and 10 μm or less from a fibrous substrate containing an ultrafine fiber-generating fiber as a main component.

Step (4): Step of imparting an elastomer to an ultrafine fiber or a fibrous substrate containing an ultrafine fiber-generating fiber as a main component.

Step (5): Step of forming a design surface on at least one surface

Hereinafter, the details of each step will be described.

<Step of Producing Ultrafine Fiber-Generating Fibers>

In this step, an island portion formed of a thermoplastic resin to be an ultrafine fiber is formed, and an ultrafine fiber-generating fiber having an islands-in-the-sea fiber structure in which an easily soluble polymer forms a sea portion is produced.

As the ultrafine fiber-generating fiber, an islands-in-the-sea fiber is used in which thermoplastic resins having different solvent solubilities are used as a sea portion (easily soluble polymer) and an island portion (hardly soluble polymer), and the sea portion is dissolved and removed using a solvent or the like to cause the island portion to form an ultrafine fiber. Use of the islands-in-the-sea fiber is favorable in view of the texture or surface quality of the artificial leather, because at the time of removing the sea portion, a suitable gap can be provided between island portions, that is, between ultrafine fibers inside a fiber bundle.

As the method of spinning the ultrafine fiber-generating fiber having an islands-in-the-sea fiber structure, a method using a mutually arranged polymer body in which a spinneret for sea-island composite fibers is used and the fiber is spun by mutually arranging a sea portion and an island portion is preferred from the viewpoint that ultrafine fibers having a uniform single fiber fineness are obtained.

As the sea portion of the islands-in-the-sea fibers, for example, a copolymerized polyester obtained by copolymerizing polyethylene, polypropylene, polystyrene, sodium sulfoisophthalic acid, polyethylene glycol or the like, and polylactic acid can be used, but polystyrene or copolymerized polyester is preferably used from the viewpoint of yarn making property, easy elutability, and the like.

In the production method for an artificial leather of the present invention, in the case of using the islands-in-the-sea fiber, an islands-in-the-sea fiber in which the strength of the island portion is 2.5 cN/dtex or more is preferably used. When the strength of the island portion is 2.5 cN/dtex or more, more preferably 2.8 cN/dtex or more, still more preferably 3.0 cN/dtex or more, the wear resistance of the artificial leather is enhanced, and at the same time, reduction in the rubbing fastness due to falling off of the fiber can be suppressed.

In the present invention, the strength of the island portion of the islands-in-the-sea fibers is calculated by the following method.

(1) 10 islands-in-the-sea fibers having a length of 20 cm are bundled.

(2) The sea portion is dissolved and removed from the sample of (1), and an air drying is performed.

(3) A test is performed 10 times (N=10) in accordance with "8.5.1 Standard time test" of "8.5 Tensile strength and percentage elongation" of JIS L 1013: 2010 "Testing methods for man-made filament yarns" under the conditions of a grasp interval of 5 cm, a tensile speed of 5 cm/min, and a load of 2 N.

(4) A value obtained by rounding the arithmetic average value (cN/dtex) of the test results of (3) to the first decimal place is employed as the strength of the island portion of the islands-in-the-sea fiber.

<Step of Producing Fibrous Substrate>

In this step, the spun-out ultrafine fiber-generating fiber is opened and passed through a cross wrapper, etc. to form a fiber web, and the fiber web is then entangled to obtain a nonwoven fabric. As the method for obtaining the nonwoven fabric by entangling the fiber web, a needle punching treatment, a water jet punching treatment, and the like can be used.

As for the form of the nonwoven fabric, either a short-fiber nonwoven fabric or a long-fiber nonwoven fabric may be used as described above, and in the case of the short-fiber nonwoven fabric, the number of fibers oriented in the thickness direction of the artificial leather is larger than that in the long-fiber nonwoven fabric, and the surface of the artificial leather at the time of being napped can give a highly dense feeling.

In the case where a short-fiber nonwoven fabric is used for the nonwoven fabric, the obtained ultrafine fiber-generating fibers are preferably crimped, cut to a predetermined length to obtain a raw cotton, then opened, stacked, and entangled, thereby obtaining a short-fiber nonwoven fabric. Generally known methods may be used for the crimping and cutting steps.

In addition, when the artificial leather includes the woven fabric, the obtained nonwoven fabric and the woven fabric are stacked and then integrated by entanglement. For the interlacing and integration of the nonwoven fabric and the woven fabric, the woven fabric is stacked on one surface or both surfaces of the nonwoven fabric, or the woven fabric is sandwiched between a plurality of nonwoven fabric webs, and then the fibers of the nonwoven fabric and the woven fabric can be interlaced by needle punching, water jet punching, or the like.

The apparent density of the nonwoven fabric including ultrafine fiber-generating fibers after needle punching or water jet punching is preferably 0.15 g/cm$^3$ or more and 0.45 g/cm$^3$ or less. An apparent density of preferably 0.15 g/cm$^3$ or more makes it possible to produce artificial leather having a sufficiently high shape stability and dimensional stability. In addition, preferably, when the apparent density is 0.45 g/cm$^3$ or lower, a sufficient space can be kept such that the elastomer is imparted.

It is also preferable for the nonwoven fabric to be subjected to heat shrinkage treatment with warm water or steam to improve the dense feeling of the fibers.

Then, the nonwoven fabric may be impregnated with an aqueous solution of a water-soluble resin and dried to add the water-soluble resin to the nonwoven fabric. Adding the water-soluble resin to the nonwoven fabric fixes the fibers and improves the dimensional stability.

<Step of Generating Ultrafine Fiber>

In this step, the obtained fibrous substrate is treated with a solvent to generate ultrafine fibers having an average single fiber diameter of single fibers of 1 μm or more and 10 μm or less.

The development of ultrafine fibers is carried out by immersing the nonwoven fabric formed of islands-in-the-sea fibers in a solvent to ensure dissolution and removal of the sea portion of the islands-in-the-sea fibers.

When the ultrafine fiber-generating fiber is an islands-in-the-sea fiber and the sea portion is polyethylene, polypropylene or polystyrene, an organic solvent such as toluene or trichloroethylene can be used as the solvent to dissolve and remove the sea portion. An aqueous alkali solution of sodium hydroxide or the like can be used when the sea portion is copolymerized polyester or polylactic acid. Hot water can be used when the sea portion is water-soluble thermoplastic polyvinyl alcohol-based resin.

<Step of Adding Elastomer>

In this step, a fibrous substrate including ultrafine fibers or ultrafine fiber-generating fibers as a main component is impregnated with a solution of an elastomer and solidified to add the elastomer. The method of fixing the elastomer to the nonwoven fabric may be a method of impregnating a solution of the elastomer into the nonwoven fabric (fiber entangled body) and then subjecting the resultant to wet coagulation or dry coagulation, and these methods can be appropriately selected according to the kind of the used elastomer.

N,N'-dimethylformamide, dimethyl sulfoxide, or the like is preferably used as the solvent used when polyurethane is added as the elastomer. A water-dispersible polyurethane liquid in which polyurethane is dispersed as an emulsion in water may be used.

The elastomer may be applied to the fibrous substrate before generating ultrafine fibers from the ultrafine fiber-generating fibers, or after generating ultrafine fibers from the ultrafine fiber-generating fibers.

<Step of Half-Cutting and Polishing Sheet-Shaped Article>

From the viewpoint of production efficiency, it is also a preferable aspect that after the completion of the step above, the sheet-shaped article provided with the elastomer is cut in half in the thickness direction to form two half-cut sheet-shaped articles.

Further, a surface of the sheet product or half-cut sheet-shaped article to which the elastomer is added may be subjected to napping treatment. The napping treatment can be performed by grinding the surface using sandpaper or a roll sander. The napping treatment can be applied to only one surface or both surfaces of this sheet-shaped article.

When the napping treatment is applied, a lubricant such as a silicone emulsion can be added to the surface of the sheet-shaped article before the napping treatment. In addition, when an antistatic agent is applied before the napping treatment, a ground powder generated from the sheet-shaped article by grinding is less likely to deposit on sandpaper.

<Step of Dyeing Sheet-Shaped Article>

It is also preferable for the sheet-shaped article to be dyed. Examples of the dyeing treatment include jet dyeing treatment using a jigger dyeing machine or a jet dyeing machine, dip dyeing treatment such as thermosol dyeing treatment using a continuous dyeing machine, and printing treatment to the piloerection surface, such as roller printing, screen printing, inkjet printing, sublimation printing, and vacuum sublimation printing. In particular, a jet dyeing machine is preferably used from the viewpoint of excellent quality and appearance from the viewpoint of obtaining a soft texture.

<Step of Forming Design Surface on at Least One Surface of Sheet-Shaped Article>

In this step, a design surface is formed on at least one surface of the sheet-shaped article obtained in the steps so far. As a result, an optional pattern is imparted to at least one surface of the sheet-shaped article, and the artificial leather according to the present invention can be obtained.

In the method for producing an artificial leather of the present invention, laser irradiation processing is preferably used for processing of forming a design surface, that is, processing of imparting a pattern. Among them, a CO2 laser whose wavelength range is included in the infrared region is more preferable. In addition, both a pulse laser and a CW laser (Continuous Wave Lazer) can be suitably used for the oscillator of the laser.

The average output of the laser beam is preferably 70 W or more and 300 W or less, and the condensing diameter is preferably 0.5 mm or less. By setting the average output and the condensing diameter within these ranges, the energy density obtained from the output and the condensing diameter can be set to $70/(n\times0.25\times0.25)$ to $300/(n\times0.25\times0.25)$ $\approx$350 (W/mm$^2$) to 1,500 (W/mm$^2$). When the energy density is within these ranges, it is possible to sufficiently heat an ultrafine fiber made of a thermoplastic resin to a temperature required for melting the ultrafine fiber, and it is possible to prevent excessive heating and suppress thermal deterioration, which is preferable. A more preferable range of the energy density is 500 (W/mm$^2$) to 1,000 (W/mm$^2$). The feeding speed of the laser beam is preferably 5 m/min or more from the viewpoint of productivity.

The artificial leather of the present invention obtained by the production method exemplified above has a soft touch like natural leather and excellent designability, and is also excellent in wear resistance, and can be widely used from furniture, chairs, and vehicle interior materials to clothing.

EXAMPLES

Hereinafter, the present invention will be described more specifically with reference to examples, but the present invention is not limited to these examples.

[Measuring Methods and Processing Methods for Evaluation]

(1) Average single fiber diameter (μm) of ultrafine fiber:

In the measurement of the average single fiber diameter of ultrafine fibers, the average single fiber diameter was calculated by observing using "VHX-D500/D510", manufactured by Keyence Corp as a scanning electron microscope.

(2) Content of thermoplastic resin in piloerection part, content of thermoplastic resin in fused part (%):

In the measurement of the content of the thermoplastic resin in the piloerection part and the content of the thermoplastic resin in the fused part, "JNM-A 400" manufactured by JEOL Ltd. was used as NMR.

(3) Difference between thickness of piloerection part and thickness of fused part (mm)

A cross-section perpendicular to the thickness direction of the artificial leather was observed at a magnification of 100 times with a scanning electron microscope (SEM, "VHX-D500/D510", manufactured by Keyence Corp.), an observed height difference between the piloerection part and the fused part was measured as a distance A-B between the uppermost point A and the lowermost point B exemplified in FIG. 1, and an average value of 20 randomly extracted convex portions was evaluated. In the lowermost point B, the lower one of the positions where the inclination of both ends disappears (0°) was selected in the convex portion.

(4) Color difference $\Delta E^*_{ab}$ and hue difference $\Delta H^*$ between piloerection part and fused part:

As a spectrophotometer, by using "CM-2600d", or the like, manufactured by Konica Minolta, Inc., a light source D is 65, a viewing angle is 10 degrees, and a measurement diameter is 3 mmφ, and measurement was performed under optical conditions in accordance with JIS Z8781-4: 2013 "Colorimetry-Part 4: CIE1976L*a*b* color space" in setting reflection.

(5) Size of Fused Material (μm):

"VHX-D500/D510", manufactured by Keyence Corp., was used as a scanning electron microscope in the measurement of the size of the fused material of the fused part of the artificial leather.

(6) Piloerection Length of Artificial Leather (μm):

"VHX-D500/D510", manufactured by Keyence Corp., was used as a scanning electron microscope in the measurement of the piloerection length of the artificial leather.

(7) Visibility of Pattern:

Evaluation was performed by visual inspection of 10 healthy subjects. The artificial leather was visually observed from a position 2 m away for 3 seconds, and the artificial leather in which 8 or more people could see the pattern (identified as a dot pattern) is classified into (A), the artificial leather in which 5 to 7 people could see the pattern is classified into (B), the artificial leather in which 3 to 4 people could see the pattern is classified into (C), and the artificial leather in which 2 or less people could see the pattern is classified into (D). Ranks A and B were rated as passed.

(8) Sharpness of Pattern:

Evaluation was performed by visual inspection of 10 healthy subjects. With regard to the sharpness of the boundary portion of the pattern, the pattern determined by 8 or more people as being sharp (the boundary portion of the pattern was smooth and clearly visible) was classified into (A), the pattern determined by 5 to 7 people was classified into (B), the pattern determined by 3 to 4 people was classified into (C), and the pattern determined by 2 or less people was classified into (D). Ranks A and B were rated as passed.

(9) Texture:

Evaluation was performed by sensory test on 10 subjects. With regard to the texture of the artificial leather, the pattern determined by 8 or more people as being good (excellent in the flexibility) was classified into (A), the pattern determined by 5 to 7 people was classified into (B), the pattern determined by 3 to 4 people was classified into (C), and the pattern determined by 2 or less people was classified into (D). Ranks A and B were rated as passed.

Example 1

<Step of Producing Raw Stock>

An ultrafine fiber-generating fiber having an islands-in-the-sea fiber structure composed of an island component and a sea component was melt-spun under the following conditions.

Island component: a mixture of the following components P1 and P2 in a mass ratio of 95: 5

P1 Polyethylene terephthalate A having an intrinsic viscosity (IV value) of 0.73

P2 A masterbatch containing 20 mass % of carbon black (average particle diameter: 0.02 μm, coefficient of variation (CV) of particle diameter: 20%) as a black pigment ($a_1$) relative to the mass of the masterbatch in the polyethylene terephthalate A Sea component: polystyrene having an MFR of 65 g/10 min Spinneret: Sea-island composite spinneret having 16 islands/hole Spinning temperature: 285° C.

Mass ratio of island portion/sea portion: 90/10

Discharge amount: 1.8 g/(minute hole)

Spinning speed: 1,100 m/min

Then, the fiber was stretched 3.0 times in a spinning oil solution bath at 90° C. Then, crimping was performed using a stuffer box crimper, followed by cutting to a length of 51 mm to provide raw stock of islands-in-the-sea fiber with a single fiber fineness of 5.9 dtex. The ultrafine fiber obtained from the islands-in-the-sea fiber had an average short fiber diameter of 5.5 μm, the ultrafine fiber had a strength of 3.4 cN/dtex, the average particle diameter of carbon black in the ultrafine fiber was 0.07 μm, and the coefficient of variation (CV) in particle diameter was 30%.

<Step of Producing Fibrous Substrate>

The raw stock obtained as described above was used to form a laminated web via carding and cross wrapper steps. The needle punching treatment was performed with a number of punches of 2,500 punches/$cm^2$ to obtain a nonwoven fabric having a basis weight of 510 g/m 2 and a thickness of 2.1 mm.

<Step of Generating Ultrafine Fiber>

The nonwoven fabric obtained as described above was shrunk with hot water at 96° C. Thereafter, the nonwoven fabric shrunk with hot water was impregnated with a polyvinyl alcohol (PVA) aqueous solution having a saponification degree of 88%, which was prepared so as to have a concentration of 12% by mass. Furthermore, the nonwoven fabric was squeezed with rollers and dried by hot air having a temperature of 120° C. for 10 minutes while allowing for migration of PVA, to obtain a PVA-impregnated sheet in which the mass of PVA was 25% by mass relative to the mass of a sheet base. The PVA-impregnated sheet thus obtained was immersed in trichloroethylene, and squeezed and compressed by a mangle ten times. Thus, dissolution removal of the sea portion and compression treatment of the PVA-impregnated sheet were performed to obtain a PVA-impregnated sheet in which the ultrafine fiber bundles to which PVA was applied were entangled.

<Step of Adding Elastomer>

A DMF (dimethylformamide) solution of polyurethane prepared so that the concentration of a solid content mainly composed of polyurethane containing carbon black as black pigment (b) (average primary particle diameter: 0.02 μm, coefficient of variation (CV) of particle diameter: 20%) was 13% was immersed in the PVA-impregnated sheet obtained as described above. Thereafter, the sea-removing PVA-impregnated sheet immersed in DMF solution of polyurethane was squeezed with rollers. Then, the sheet was immersed in a DMF aqueous solution having a concentration of 30% by mass to solidify the polyurethane. After that, PVA and DMF were removed by hot water, and a silicone oil emulsion solution adjusted to a concentration of 1% by mass was impregnated, thereby applying a silicone-based lubricant such that the applied amount thereof was 0.4% by mass relative to the total mass of the mass of the fibrous substrate and the mass of the polyurethane, and drying was performed with hot air having a temperature of 110° C. for ten minutes. As a result, a polyurethane-impregnated sheet having a thickness of 1.7 mm and a polyurethane mass of 29% by mass relative to the mass of the fibrous substrate was obtained.

<Step of Half-Cutting and Napping>

The polyurethane-impregnated sheet obtained as described above was cut in half such that the thickness of each part was ½. Subsequently, a napping treatment was performed by grinding the surface layer portion of the half-cut surface by 0.3 mm with an endless sandpaper having a sandpaper grit size of 180 to obtain a piloerection sheet having a thickness of 0.6 mm.

<Step of Dyeing and Finishing>

The piloerection sheet obtained as described above was dyed using a jet dyeing machine. At this time, a black dye was used at 120° C., and the L* value of the sheet after dyeing was adjusted to 22. Thereafter, a drying treatment was performed at 100° C. for 7 minutes to obtain a dyed sheet having an average single fiber diameter of the ultrafine fiber of 5.5 μm, a basis weight of 255 g/m$^2$, a thickness of mm, and the piloerection length of 330 μm.

<Step of Imparting Pattern>

Using a carbon dioxide laser (pulse oscillation type) irradiator having a wavelength of 10.6 μm, a pattern of a dot pattern (regular triangles each having a side of 5 mm were arranged in a zigzag lattice pattern at intervals of 10 mm) was imparted to the artificial leather obtained as described above. At this time, processing was performed at a feeding speed of the dyed sheet in the length direction of 11 cm/min, a pulse frequency of 50 kHz, an average output of 110 W, a condensing diameter of 0.5 mm, and a moving speed of the laser processing point in the width direction of the dyed sheet of 9 m/min, thereby obtaining an artificial leather. The obtained artificial leather had excellent pattern visibility, sharpness, and texture. The results are shown in Table 1.

Example 2

A patterned artificial leather was obtained in the same manner as in Example 1 except that processing was performed at an average output of 150 W in the step of imparting a pattern. The obtained artificial leather had excellent pattern visibility, sharpness, and texture. The results are shown in Table 1.

Example 3

A patterned artificial leather was obtained in the same manner as in Example 2 except that only P1 was used as the island component in the step of producing raw cotton. The obtained artificial leather had excellent pattern visibility, sharpness, and texture. The results are shown in Table 1.

Example 4

An artificial leather was obtained in the same manner as in Example 2 except that in the step of producing raw cotton, the mass ratio of the island portion/the sea portion was 80/20, the discharge amount was 1.2 g/(min·hole), the stretch ratio was 2.7 times, and the average short fiber diameter of the ultrafine fiber was 4.4 μm. The obtained artificial leather had excellent pattern visibility, sharpness, and texture. The results are shown in Table 1.

Comparative Example 1

An artificial leather was obtained in the same manner as in Example 3 except that in the step of imparting a pattern, an imprinting paste having the following composition was applied and dried using a screen textile printer, and then irradiated with near infrared rays having a main wavelength of 750 μm at a cloth speed of 4 m/min. In the obtained artificial leather, not only a textile portion but also an elastomer containing a black pigment was heated and cured by infrared irradiation, and thus the artificial leather was poor in texture. The results are shown in Table 1.

<Imprinting Paste Composition>

- Original paste (guar gum solid content: 15%) 35.5 parts by mass
- Textile printing agent ("S-10" manufactured by Nippon Chemical Industrial Co., Ltd.) 30.0 parts by mass
- Carrier ("Terrile Carrier FPL" manufactured by Meisei Chemical Works, Ltd.) 5.0 parts by mass
- Graphite powder 1.5 parts by mass
- Disperse dye (Nippon Chemical Industrial Co., Ltd.) 8.0 parts by mass
- Water 20.0 parts by mass Comparative Example 2

An artificial leather was obtained in the same manner as in Example 2 except that an average output was set as 300 W in the step of imparting a pattern. The patterned artificial leather was perforated at the fused part. The results are shown in Table 1.

Comparative Example 3

An artificial leather was obtained in the same manner as in Example 2 except that an average output was set as 190 W in the step of imparting a pattern. The obtained artificial leather was inferior in sharpness and texture of the pattern. The results are shown in Table 1.

Comparative Example 4

An artificial leather was obtained in the same manner as in Example 2 except that an average output was set as 60 W in the step of imparting a pattern. The obtained artificial leather was inferior in visibility and sharpness of the pattern. The results are shown in Table 1.

TABLE 1-1

| | Example 1 | Example 2 | Example 3 | Example 4 | Comparative Example 1 |
|---|---|---|---|---|---|
| Average single fiber diameter of ultrafine fiber (μm) | 5.5 | 5.5 | 5.5 | 4.4 | 5.5 |
| When content of thermoplastic resin in piloerection part is 100 parts by mass, content of thermoplastic resin in fused part | 100 | 100 | 100 | 100 | 95 |
| Difference in thickness between piloerection part and fused part (mm) | 0.15 | 0.17 | 0.17 | 0.18 | 0.18 |
| Color difference $\Delta E^*_{ab}$ (−) between piloerection part and fused part | 7.8 | 13.6 | 14.8 | 14.0 | 12.5 |
| Hue difference ΔH* (−) between piloerection part and fused part | 0.23 | 0.58 | 0.74 | 0.41 | 0.87 |

TABLE 1-1-continued

| | Example 1 | Example 2 | Example 3 | Example 4 | Comparative Example 1 |
|---|---|---|---|---|---|
| Presence or absence of black pigment in ultrafine fiber | Present | Present | Absent | Present | Absent |
| Presence or absence of black pigment in elastomer | Present | Present | Present | Present | Present |
| Size of fused material (μm) | 30 | 100 | 110 | 135 | 190 |
| Visibility of pattern | B | A | A | A | A |
| Sharpness of pattern | A | A | A | A | C |
| Texture | A | A | A | B | D |

TABLE 1-2

| | Comparative Example 2 | Comparative Example 3 | Comparative Example 4 |
|---|---|---|---|
| Average single fiber diameter of ultrafine fiber (μm) | 5.5 | 5.5 | 5.5 |
| When content of thermoplastic resin in piloerection part is 100 parts by mass, content of thermoplastic resin in fused part | 100 | 100 | 100 |
| Difference in thickness between piloerection part and fused part (mm) | — | 0.35 | 0.03 |
| Color difference $\Delta E^*_{ab}$ (−) between piloerection part and fused part | — | 15.0 | 2.4 |
| Hue difference ΔH* (−) between piloerection part and fused part | — | 0.04 | 0.07 |
| Presence or absence of black pigment in ultrafine fiber | Present | Present | Present |
| Presence or absence of black pigment in elastomer | Present | Present | Present |
| Size of fused material (μm) | — | 210 | 15 |
| Visibility of pattern | D (Perforated) | A | C |
| Sharpness of pattern | D (Perforated) | C | B |
| Texture | D (Perforated) | C | A |

DESCRIPTION OF REFERENCE SIGNS

A: Uppermost point of artificial leather in thickness direction

B: Lowermost point of artificial leather in thickness direction

C: Measurement Example 1 of size of fused material

D: Measurement Example 2 of size of fused material

E: Measurement Example 3 of size of fused material

F: Measurement Example 4 of size of fused material

The invention claimed is:

1. An artificial leather comprising:

a fiber entangled body which contains, as a constituent, a nonwoven fabric that is configured from ultrafine fibers that are formed from a thermoplastic resin, while having an average single fiber diameter of from 1 μm to 10 μm; and an elastomer, wherein at least one surface of the artificial leather is a design surface that has at least a piloerection part and a fused part; if a content of the thermoplastic resin in the piloerection part is taken as 100 parts by mass, a content of the thermoplastic resin in a fused material in the fused part is from 99 parts by mass to 100 parts by mass; a difference between a thickness of the piloerection part and a thickness of the fused part is from 0.05 mm to 0.19 mm; and formulae (1) to (3) described below are satisfied, $$\Delta E^*_{ab} \geq 5 \quad (1)$$

$$0 \leq \Delta H^*_{ab} \leq 1 \quad (2)$$

$$2D \leq \varphi \leq 150 \quad (3)$$

here, $\Delta E^*_{ab}$ is a CIELAB1976L*a*b* color difference between the piloerection part and the fused part, $\Delta H^*_{ab}$ is a CIELAB1976 hue difference between the piloerection part and the fused part, D is the average single fiber diameter (μm) of the ultrafine fibers, and φ is a size (μm) of the fused material.

2. The artificial leather according to claim 1, wherein the ultrafine fibers contain a black pigment in addition to the thermoplastic resin.

3. The artificial leather according to claim 1, wherein the elastomer contains a black pigment.

4. The artificial leather according to claim 1, wherein the average single fiber diameter of the ultrafine fibers is from 1.5 μm to 6.0 μm.

5. The artificial leather according to claim 1, wherein a piloerection length in the piloerection part on the surface is 200 μm or more and 500 μm or less.

6. A vehicle interior material comprising the artificial leather according to claim 1.

* * * * *